US005411347A

United States Patent [19]

Bowmer et al.

[11] Patent Number: 5,411,347

[45] Date of Patent: May 2, 1995

[54] HIGH DYNAMIC STRENGTH REINFORCING BAR SPLICE AND METHOD OF MAKING

[75] Inventors: Geoffrey M. Bowmer, Al Oisterwijk; Paulus W. T. Gruson, St Tilburg, both of Netherlands

[73] Assignee: Erico International Corporation, Solon, Ohio

[21] Appl. No.: 209,595

[22] Filed: Mar. 10, 1994

Related U.S. Application Data

[63] Continuation of Ser. No. 825,626, Jan. 24, 1992, abandoned.

[51] Int. Cl.[6] ..... F16B 7/18

[52] U.S. Cl. ..... 403/305; 403/307; 403/343; 52/726.1

[58] Field of Search ..... 403/305-308, 403/300, 43, 47, 342, 343, 333, 334, 299, 284, 285; 52/726.1, 728; 72/89; 29/452, 516, 517

[56] References Cited

U.S. PATENT DOCUMENTS

| | | | |
|---|---|---|---|
| 3,065,983 | 11/1962 | Flumerfelt | 403/43 |
| 3,415,552 | 12/1968 | Howlett | 403/334 X |
| 3,782,839 | 1/1974 | Majewski | 52/726.1 |
| 3,850,535 | 11/1974 | Howlett et al. | 403/305 |
| 4,146,951 | 4/1979 | Howlett | 29/452 |
| 4,870,848 | 10/1989 | Kies et al. | 72/89 |
| 5,067,844 | 11/1991 | Bolumer et al. | 403/305 |
| 5,152,118 | 10/1992 | Lancelot | 52/726.1 |
| 5,158,527 | 10/1992 | Bernard | 403/307 X |

FOREIGN PATENT DOCUMENTS

| | | | |
|---|---|---|---|
| 2205772 | 8/1973 | Germany | 52/726.1 |
| 2223556 | 12/1973 | Germany | 52/726.1 |
| 3131078 | 10/1982 | Germany . | |
| 960685 | 6/1964 | United Kingdom | 52/726.1 |
| 1546253 | 5/1979 | United Kingdom | 403/307 |

*Primary Examiner*—Dave W. Arola
*Assistant Examiner*—Harry C. Kim
*Attorney, Agent, or Firm*—Renner, Otto, Boisselle & Sklar

[57] ABSTRACT

A high dynamic strength or fatigue resistance is achieved in a taper thread reinforcing bar splice for use in steel reinforced concrete by coordinating the elongations of the coupler sleeve and bar to achieve the required movements of the coupler sleeve at the mouth. This is accomplished in the preferred embodiment by two attenuation grooves on the outside of a circular cylindrical coupler body at each end, each groove being placed in a particular axial relationship with respect to the end of the coupler sleeve and the area of thread engagement with the bar. The grooves are of different depths, with the groove closest to the mouth of the coupler sleeve being the deepest. Also the diameter of the circular cylindrical coupler body at each end is selected so that the wall thickness at the mouth is as thin as possible. At the center of the coupler sleeve there is an enlarged portion extending axially several threads beyond the last thread of each bar joined. The enlarged portion may be circular or hexagonal in exterior configuration. A lead chamfer which forms the innermost side wall of the attenuation grooves closest to the center of the coupler sleeve is desired to avoid excessive stress concentration at the side of these grooves. For such improved fatigue or dynamic performance of the splice, and efficient static performance, it is preferred to employ rolled bar thread in the splice system.

40 Claims, 1 Drawing Sheet

HIGH DYNAMIC STRENGTH REINFORCING BAR SPLICE AND METHOD OF MAKING

This is a continuation of application Ser. No. 07/825,626 filed on Jan. 24, 1992, now abandoned.

This invention relates generally to a high dynamic strength reinforcing bar splice and, more particularly, to a high dynamic and static strength taper thread splice for concrete reinforcing bar, a coupler sleeve therefor, and a method of making such sleeve and splice.

BACKGROUND OF THE INVENTION

In steel reinforced concrete structures static strength of the steel reinforcing bars or associated couplers or splices has received most attention. However, as larger and more complex structures are designed using steel reinforced concrete, there has developed a need for a steel reinforcing bar splice system having greatly increased dynamic strength.

It has been discovered by significant testing that the weakest point in fatigue in a taper thread reinforcing bar splice is in the area of the partial threads on the bar which are formed at the ribs or deformations on the outside of the bar. This area of the bar threads is that area covered by the mouth of the coupler. The bar develops fatigue sensitivity at the first engaged partial thread, caused by the inability of the partial threads to transfer significant load into the corresponding portion of the sleeve. Accordingly, in fatigue testing to failure of conventional taper threaded reinforcing bar couplings, most failures are bar failures occurring at the mouth of the coupling sleeve.

It has been discovered that taper threaded reinforcing bar splices can achieve significantly greater dynamic strengths if the elongations of the coupler sleeve and bar are coordinated. This is difficult to do and still maintain a shape to the coupler sleeve which is both serviceable and easy to manufacture.

It is also important that a taper thread splice for reinforcing bar be developed having greatly improved dynamic strength without compromising static performance.

SUMMARY OF THE INVENTION

A greatly improved dynamic strength is achieved in a taper thread reinforcing bar splice for use in steel reinforced concrete by coordinating the elongations of the coupler sleeve and bar to achieve the required movements of the coupler sleeve at the mouth. This is accomplished in the preferred embodiment by two attenuation grooves on the outside of a circular cylindrical coupler sleeve body at each end, each groove being placed in a particular axial relationship with respect to the end of the coupler sleeve, and the area of thread engagement with the bar. The grooves are of different depths, with the grooves closest to the mouth of the coupler sleeve being the deepest. Also the diameter of the circular cylindrical coupler body at each end is selected so that the wall thickness at the mouth is as thin as possible. Maintaining a circular cylindrical outside diameter at each end of the bar is important in the manufacturing of the coupler sleeve. At the inner or central portion of the coupler sleeve there is an enlarged diameter central portion extending axially several threads beyond the last thread of each bar joined. The enlarged central portion may be circular or hexagonal in exterior configuration. A lead chamfer which forms the innermost side wall of the attenuation grooves closest to the center of the coupler sleeve is desirable to avoid excessive stress concentration at the inner side of these grooves. For such improved fatigue or dynamic performance of the splice, and efficient static performance, it is preferred to employ rolled bar thread in the splice system.

DETAILED DESCRIPTION OF THE PREFERRED EMBODIMENTS

Figure 1:
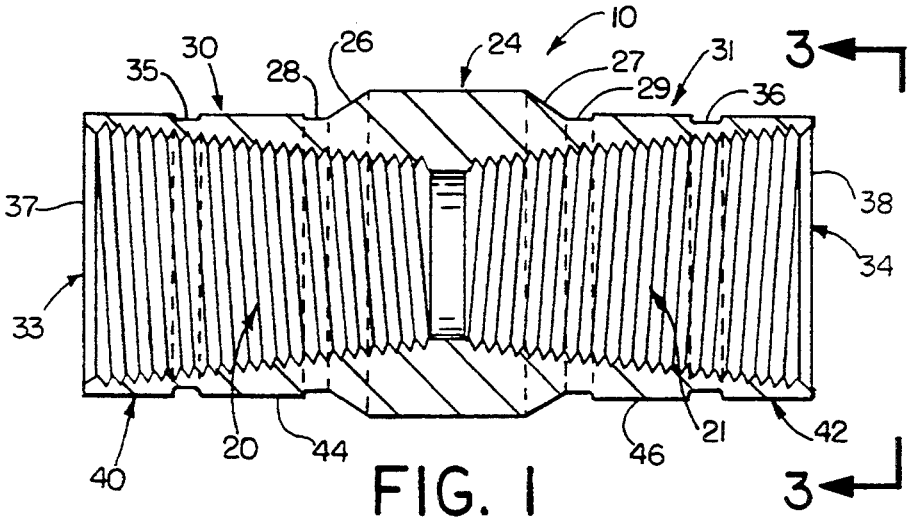
FIG. 1 is an axial section of the coupler sleeve of the present invention in its preferred form.
Figure 2:
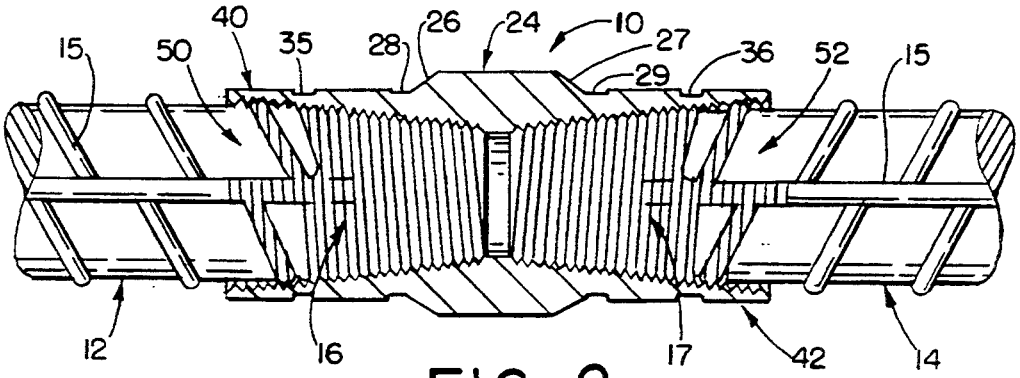
FIG. 2 is a section similar to FIG. 1, but on a somewhat reduced scale showing the sleeve and adjoining bar torqued in place, thus illustrating the joint.
Figure 3:
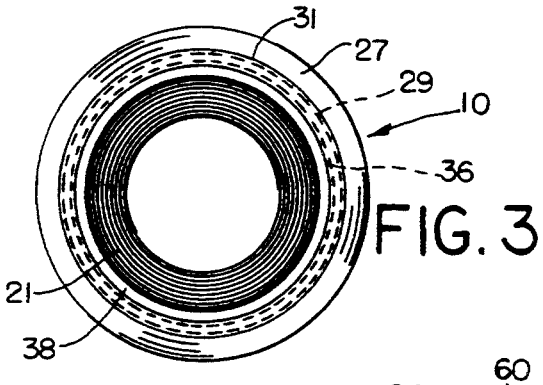
FIG. 3 is an axial end elevation of the coupler sleeve as seen in FIG. 3 from the line 3—3 thereof; and, FIG. 4 is an enlarged fragmentary quarter section of the sleeve illustrating the details of the attenuation grooves and the transition chamfer.

Referring initially to FIGS. 1, 2 and 3, there is illustrated a coupler sleeve 10 in accordance with the present invention, which is illustrated joining reinforcing bars 12 and 14 in a butt splice in FIG. 2. Each reinforcing bar is provided with ribs or deformations indicated at 15 in conventional manner and each bar end is provided with a tapered thread as seen at 16 and 17 for the bars 12 and 14, respectively. The threads on the ends of the reinforcing bar may be cut by a machine such as shown in the copending application Ser. No. 07/334,333, U.S. Pat. No. 5,158,404, entitled "Taper Thread Forming Machine" filed on Apr. 7, 1989. However, preferably, the threads 16 and 17 are formed by roll forming and this may be accomplished by a machine such as, for example, shown in prior U.S. Pat. No. 4,819,469, dated Apr. 11, 1989, entitled "Method For Rolling Tapered Threads on Bars", or U.S. Pat. No. 4,870,848, dated Oct. 3, 1989, entitled "Tapered Rolled Thread Bar Joint". The present invention provides an improved dynamic strength taper thread reinforcing bar splice, whether the threads on the bar are cut or rolled. However, rolled threads provide such dynamic improvements while maintaining high static performance.

The sleeve 10 is provided with internal taper threads indicated at 20 and 21, which match the taper threads 16 and 17 of the bars 12 and 14, respectively.

The entire sleeve may be circular in section as noted in FIG. 3 and the sleeve includes an enlarged central portion 24 which extends axially several threads beyond the innermost threads of both the internal thread sections 20 and 21 as well as the external corresponding thread sections 16 and 17 of the respective bars. However, the sleeve may be turned from hex stock which hex exterior configuration would then remain for the enlarged center portion 24 only. Each end of the enlarged central portion 24 joins a transition chamfer as seen at 26 and 27 which extends axially outwardly at a relatively shallow angle such as 30°, and which terminates directly in the bottom of an annular attenuation groove as indicated at 28 and 29. Axially outwardly from the attenuation grooves 28 and 29, the coupler body is provided with end sections seen at 30 and 31, respectively, of uniform external diameter. Such uniform diameter sections extend from the axial innermost attenuation grooves 28 and 29 to the opposite ends or mouth of the coupler as seen at 33 and 34. A second somewhat deeper attenuation groove is provided in the uniform diameter end sections as seen at 35 and 36. The axial outermost attenuation grooves 35 and 36 are spaced from the end or each mouth of the sleeve slightly less than the spacing between each attenuation groove in each end section. The outside diameter of each end section is selected so that the sleeve wall thickness at each mouth is as thin as possible, accommodating the internal threads and a 45° chamfer at each mouth as seen at 37 and 38.

The outermost attenuation grooves provide a ring section indicated generally at 40 and 42 at each mouth which is movable axially with respect to the central or enlarged portion 24 of the sleeve as the bar of the splice elongates and relaxes under cyclic tensile loads. In addition, the intermediate ring sections of the sleeve between the two attenuation grooves indicated at 44 and 46, also move but to a lesser extent. In fact, the entire end sections of the sleeve elongate and relax under cyclic tensile loads with such elongation simply being concentrated at the attenuation grooves. In this-manner, the elongations of the bar and the sleeve are coordinated to achieve greatly increased dynamic strength.

The location of the axial outermost attenuation grooves 35 and 36 is selected to be substantially axially inside the area of partial threads on the bar which are seen at 50 and 52. Such partial threading occurs because of the ribs or deformations on the outside of the reinforcing bar with the largest diameter threads on the bar being formed only in such ribs or deformations. In this manner, the area of partial threads on the bar is embraced by the annular end sections 40 and 42 of the sleeve which are capable of the most axial movement or elongation. The area of partial threads will of course vary depending upon type of the bar and deformations employed.

The thread geometry of the splice system may be the same as that for the well-known LENTON® reinforcing bar splices sold by Erico Incorporated of Solon, Ohio. Such taper thread system is typically a 6° cone and the diameters and lengths depend on the size of the bar. The steel of the bar is standard reinforcing steel with high bond characteristics. For the bar, a typical steel might be KS 410 S which is derived from a Scandinavian steel specification. Deformed high bond reinforcing steel in Scandinavia is referred to as "KAMSTAHL". The numbers refer to the guaranteed yield strength in Newtons/mm$^2$ and the "S" means weldable. The steel of the coupler is a steel with a high tensile strength, considerably higher than the steel of the bar.

Figure 4:
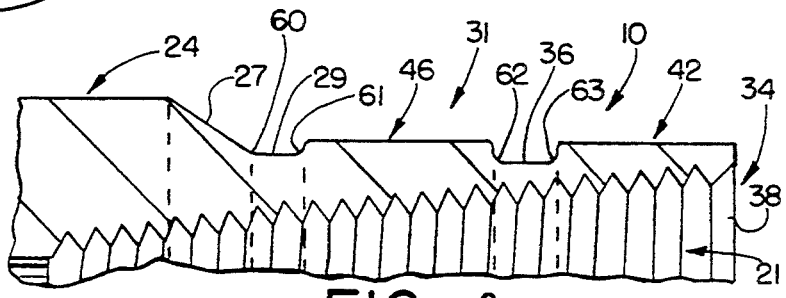

The elongated 30° chamfer 27, as seen more clearly in FIG. 4, terminates at the bottom of the attenuation groove 29, joining such bottom with a shallow radius 60. In this manner, the chamfer forms the interior side wall of the initial attenuation groove. The bottom of the attenuation groove joins the relatively short outer side wall by radius 61. The outermost attenuation groove 36 also has significant radii at the interior corners as indicated at 62 and 63.

Although the dimensions of the sleeve may vary widely, particularly with the size of bar being employed, the following dimensions of the illustrated sleeve are to be considered exemplary only for a 35 mm bar. The uniform diameter end section may have an outside diameter of about 42 mm while the enlarged central section may have an outside diameter of about 48 mm. Both attenuation grooves are approximately 5 mm in axial length, while the innermost attenuation groove or the groove into which the chamfer extends is approximately 0.8 mm deep. The outermost grooves are approximately 1.4 mm deep. The edge of the innermost groove is approximately 31 mm from the mouth the coupler sleeve while the axial outermost groove is approximately 9 mm from the mouth of the sleeve. As indicated, the outside diameter of the uniform diameter end section is selected to achieve a minimal wall thickness at the root of the largest thread of at least one ram. For some coupler sleeves, longer or larger than that illustrated, more than the two attenuation grooves illustrated may be employed.

In any event, it is seen that there is provided a high dynamic strength reinforcing bar splice which has excellent resistance to fatigue and which also has high static performance. The uniform outer diameter sections at each end of the coupler sleeve enable the sleeve readily to be gripped in a chuck for proper turning.

Fatigue tests have been performed on couplers in accordance with the present invention. Fatigue tests were performed on a 250 kN Schenck fatigue testing machine. For testing the couplers were fitted with a torque of 314 Nm. The maximum tensile stress was 150 N/mm$^2$. The minimum tensile stress was 10 N/mm$^2$. The frequency was 20 Hz. The following results were obtained as set forth in Table 1 below.

TABLE 1

Fatigue tests on reinforcing steel couplers EL-35-A3F

| | Stress | | Load | | Number of Load | |
|---|---|---|---|---|---|---|
| Bar nr. | Rmax (N/mm$^2$) | Rmin (N/mm$^2$ | Fmax (kN) | Fmin (kN) | Cycles n | Fractures |
| K1 | 150 | 10 | 145 | 10 | $3 \times 10^6$ | NONE |
| K2 | 150 | 10 | 145 | 10 | $3 \times 10^6$ | NONE |

Accordingly, it will be seen that splices in accordance with the present invention tested at in excess of 3,000,000 cycles without fracture. The results substantially exceed a standard of no fracture at $2 \times 10^6$ load cycles at a fatigue stress fluctuation of $\frac{1}{3}$ of the yield point stress of the reinforcing steel which corresponds with 140 N/mm$^2$, and exceed the values obtained with a constant diameter cylindrical sleeve by a factor of more than five. The sleeves in accordance with the present invention were also tested for static strength which was found not to be compromised by the high dynamic strength of the splice and sleeve.

It will be appreciated that the principal of the present invention may be applied to reinforcing bar splices of the type illustrated wherein bars of the same size are joined axially, to splices where two different size bars are joined, or to anchors where only one bar is threaded into what is, in effect, a half sleeve.

It can now be seen that there is provided a sleeve for a tapered thread concrete reinforcing bar splice wherein the sleeve has an enlarged center portion and an annular section of the mouth which is movable axially with respect to the enlarged center portion as the bar elongates and relaxes under cyclic tensile loads. The coordination of the elongations of the coupler and bar is obtained by attenuation grooves placed along the coupler sleeve body with the inner portion of the coupler sleeve transcending into a uniform lesser diameter end section by a lead chamfer thus smoothing the stress at the beginning of the heavy central portion. Applicant's have thus provided a method of improving the fatigue properties of a taper thread concrete reinforcing bar splice by coordinating the elongations which occur in both the bar and sleeve.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

We claim:

1. A concrete reinforcing bar splice having improved fatigue resistance comprising substantially aligned reinforcing bars, each bar having a taper threaded end, a sleeve having an exterior and corresponding tapered internal threads at each end, said each end of said sleeve threaded on the corresponding thread of the joined reinforcing bars, said exterior of said sleeve being circular in transverse section at said each end and including a wall thickness radially outwardly enlarged central portion, and at least one annular attenuation groove in said sleeve, said sleeve axially beyond said central portion tapering to a thin wall thickness at said each end, whereby an elastic elongation of the sleeve will more closely match that of the taper threaded bar ends providing a high dynamic strength splice.

2. A bar splice as set forth in claim 1 including an exterior chamfer from said enlarged central portion to a substantially uniform outside diameter end section at said each end of the sleeve.

3. A bar splice as set forth in claim 2 including one or more annular attenuation grooves in each said uniform outside diameter end section.

4. A bar splice as set forth in claim 1 including annular attenuation grooves in said exterior of the sleeve to control the elongation thereof.

5. A bar splice as set forth in claim 4 including at least two axially spaced such grooves at said each end of the sleeve.

6. A bar splice as set forth in claim 5 wherein the groove closest to the end of the sleeve is deeper than the groove closest to the center of the sleeve.

7. A bar splice as set forth in claim 1 wherein said enlarged central portion of the sleeve extends axially beyond the last thread on said each bar when joined by the splice.

8. A bar splice as set forth in claim 7 including a chamfer at each end of said enlarged central portion tapering to substantially uniform outside diameter end sections at said each end of said sleeve.

9. A bar splice as set forth in claim 8 wherein each sleeve end section includes said at least one annular attenuation groove.

10. A bar splice as set forth in claim 9 including at least two annular attenuation grooves in said each end section.

11. A bar splice as set forth in claim 10 wherein each said chamfer form an inner side wall of an axially innermost grooves.

12. A bar splice as set forth in claim 10 wherein an axially innermost groove is shallower than an axially outermost groove.

13. A bar splice as set forth in claim 12 wherein said each bar joined has an area of partial threads near the end of the sleeve, said axially outermost grooves being positioned substantially axially inwardly adjacent said area of partial threads when said bars are joined by the splice.

14. A bar splice as set forth in claim 9 wherein said each end section has an outside diameter to provide a thin sleeve wall at said each end of the sleeve.

15. A bar splice as set forth in claim 1 wherein the tapered threads on said bars are roll formed.

16. A sleeve for a taper thread concrete reinforcing bar splice having improved fatigue resistance, said sleeve having tapered internal threads at each end matching tapered threads on a bar to be spliced, an exterior of said sleeve being circular in transverse section at said each end and including a wall thickness radially outwardly enlarged central portion, said sleeve axially beyond said central portion tapering to a thin wall thickness at said each end thereby enabling threaded sections of the sleeve to elongate in coordination with the bar, and at least one annular attenuation groove in said sleeve.

17. A sleeve as set forth in claim 16 including an exterior chamfer from said enlarged central portion to a substantially uniform outside diameter end section at said each end of the sleeve.

18. A sleeve as set forth in claim 17 including one or more annular attenuation grooves in each said uniform outside diameter end section.

19. A sleeve as set forth in claim 16 including annular attenuation grooves in the exterior of the sleeve to control the elongation thereof.

20. A sleeve as set forth in claim 19 including at least two axially spaced such grooves at said each end of the sleeve.

21. A sleeve as set forth in claim 20 wherein the groove closest to the end of the sleeve is deeper than the groove closest to the center of the sleeve.

22. A sleeve as set forth in claim 18 including at least two annular attenuation grooves in said each end section.

23. A sleeve as set forth in claim 22 wherein each said chamfers forms an inner side wall of an axially innermost groove.

24. A sleeve as set forth in claim 22 wherein an axially innermost groove is shallower than an axially outermost groove.

25. A sleeve as set forth in claim 22 wherein said each end section has an outside diameter providing a thin sleeve wall at each end of the sleeve.

26. A method of improving the fatigue properties of a taper thread concrete reinforcing bar splice comprising the steps of providing a sleeve having internal taper threads at each end matching external tapered threads on the ends of bars to be joined, providing the sleeve with at least one annular attenuation groove, and controlling a wall thickness of the sleeve along thread engaging sections to coordinate elongations of the sleeve and bar when joined.

27. A method as set forth in claim 26 including the step of providing the exterior of the sleeve with more than said one annular attenuation groove.

28. A method as set forth in claim 27 including the step of reducing a maximum root stress on the bar threads at a bar point by providing a chamfer over such bar point thread from a maximum sleeve wall thickness at the center of the sleeve.

29. A method as set forth in claim 28 including the step of extending the chamfer to the bottom of said attenuation groove.

30. A method as set forth in claim 27 including the step of providing said each end of the sleeve with an end section of substantially uniform outside diameter.

31. A method as set forth in claim 30 including the step of providing said each end section with at least two attenuation grooves.

32. A method as set forth in claim 31 including an step of making the axial outermost groove deeper than an axial innermost groove.

33. A method as set forth in claim 32 wherein the taper threads on the ends of the bar have an area of partial threads near the end of the sleeve, and locating a deepest attenuation groove substantially just axially inside said area of partial threads.

34. A method of claim 26 including the step of roll forming the tapered threads on the bars.

35. In a threaded reinforcing bar connection, a coupler sleeve having internal threads adapted to match threads on the end of a reinforcing bar to be joined with said sleeve, said sleeve having an enlarged portion adapted to surround the end of the bar within the sleeve, and an end into which the bar is threaded, the end of the coupler sleeve including a first annular ring movable axially with respect to said enlarged portion as the bar elongates and relaxes under cyclic tensile loads.

36. A bar connection as set forth in claim 35 wherein said first ring is formed by a first annular attenuation groove axially interior of the ring.

37. A bar connection as set forth in claim 36 including a second ring between said first ring and first groove and said enlarged portion and movable to a lesser extent than said first ring.

38. A bar connection as set forth in claim 37 including a second attenuation groove between said second ring and said enlarged portion.

39. A bar connection as set forth in claim 38 wherein said first groove is deeper than said second groove.

40. A bar connection as set forth in claim 39 including a transition chamfer extending from said enlarged portion to the bottom of said second groove. This is a continuation of copending application Ser. No. 07/825,626, filed on Jan. 24, 1992, now abandoned.

* * * * *